US006817927B2

(12) United States Patent
Smith et al.

(10) Patent No.: US 6,817,927 B2
(45) Date of Patent: Nov. 16, 2004

(54) METHOD OF REMOVING MATERIAL FROM AN EXTERNAL SURFACE USING CORE/SHELL PARTICLES

(75) Inventors: Dennis E. Smith, Rochester, NY (US); Christopher J. Puccini, Rochester, NY (US); David W. Gruszczynski, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 331 days.

(21) Appl. No.: 10/045,718

(22) Filed: Oct. 19, 2001

(65) Prior Publication Data

US 2003/0077984 A1 Apr. 24, 2003

(51) Int. Cl.[7] ..... B24B 1/00
(52) U.S. Cl. ..... 451/38; 451/39; 451/40
(58) Field of Search ..... 451/39, 40, 533, 451/534, 38, 330; 51/297, 299, 300, 307, 308, 309

(56) References Cited

U.S. PATENT DOCUMENTS

| | | | | | |
|---|---|---|---|---|---|
| 4,731,125 | A | | 3/1988 | Carr | |
| 4,878,320 | A | | 11/1989 | Woodson | |
| 5,234,470 | A | | 8/1993 | Lynn et al. | |
| 5,239,788 | A | * | 8/1993 | Woodson | 451/39 |
| 5,380,347 | A | * | 1/1995 | Winston et al. | 51/293 |
| 5,505,749 | A | | 4/1996 | Kirschner et al. | |
| 5,509,971 | A | | 4/1996 | Kirschner | |
| 5,575,706 | A | * | 11/1996 | Tsai et al. | 438/693 |
| 6,478,878 | B1 | * | 11/2002 | Tanaka et al. | 134/7 |
| 6,502,442 | B2 | * | 1/2003 | Arola et al. | 72/53 |

FOREIGN PATENT DOCUMENTS

| | | |
|---|---|---|
| EP | 1 020 488 A2 | 7/2000 |
| EP | 1 104 778 A2 | 6/2001 |

* cited by examiner

*Primary Examiner*—Eileen P. Morgan
(74) *Attorney, Agent, or Firm*—Chris P. Konkol

(57) ABSTRACT

This invention relates generally to methods for removing adherent materials, for example, paint, flashes, burrs, photoresists, contaminants, and other materials from various external surfaces. In particular, the method employs an improved media comprising core/shell particles. The media can be propelled against or along the surface by a gaseous or liquid carrier medium or a mixture of gas and liquid to remove the unwanted surface material. In one embodiment, suitable blasting equipment propels the media, via a pressurized air stream, against a surface of an object, for example an airplane skin, to dislodge the material to be removed.

17 Claims, No Drawings

METHOD OF REMOVING MATERIAL FROM AN EXTERNAL SURFACE USING CORE/SHELL PARTICLES

FIELD OF THE INVENTION

This invention relates generally to methods for removing adherent materials, for example, paint, flashes, photoresists, contaminants, and other materials from external surfaces. In particular, the method employs an improved media comprising core/shell particles.

BACKGROUND OF THE INVENTION

For various types of structures, it is often desirable to remove a coating that has been formed on an exterior surface area. In one case, the coating may be unwanted contamination. In another case the coating may be an intentionally applied material such as a decorative or protective layer. Numerous techniques exist for removing paint, sealants, lacquers, rust, scale, biogrowth and other adherent materials from virtually any type of surface. Surface cleaning or stripping methods range from mechanical abrasion to the use of strong chemicals and involve varying degrees of time, effort and expense. For any given type of coating, the character and function of the substrate material from which a coating is to be removed usually dictates the stripping method, at least in industrial settings.

In view of the environmental and health hazards involved in the use of solvents for cleaning surfaces, in particular, large exterior surfaces, it has become common practice to use an abrasive blasting technique wherein abrasive particles are propelled by a high pressure fluid against the solid surface in order to dislodge previously applied coatings, scale, dirt, grease or other contaminants. Hard, durable surfaces, such as heavy steel plating can be cleaned or stripped by a hard abrasive such as sand. Softer metals such as aluminum or more delicate surfaces such as polymer composite layers may require the use of a softer abrasive material during blasting such as plastic pellets or sodium bicarbonate.

Sand blasting of steel plate or other hard surface to remove adherent coatings and the like, while successful in removing the coatings, has several disadvantages. For one, the sand abrasive is very friable such that upon contact with the surface, a vast amount of silica dust is formed. There is a concern that the minute air-borne free-silica particles which are formed during blasting present a substantial health hazard, in particular, if ingested into the lungs. Secondly, very large amounts of sand are required for cleaning large structures such as bridges, stacks, etc. such that after blasting, this sand remains and must be removed from the blast cleaning area adding substantially to the time and expense of the blasting process.

Alternative abrasives for blast cleaning hard surfaces are known. For example, U.S. Pat. No. 3,775,180 is directed to a method for descaling steel in which the steel is descaled by spraying a mixture of a solid such as aluminum oxide or silicon carbide with water and a gas such as air under specified conditions onto the steel. In removing a coating or a scale on the surface of a metal, however, it is important that the anchor pattern (surface roughness) of the metal surface be uniform and not too extensive such that the surface and even the metal structure is damaged. A blast media composed only of hard aluminum oxide and silicon carbide can be detrimental to the metal structure.

Hard abrasives such as alumina, silicon carbide, or glass bead, or a soft abrasive such as a walnut shell flour has been blasted at a high speed onto molded products to remove flashes. U.S. Pat. No. 4,548,617 describes the problems associated with using these abrasives.

For certain surfaces such as metals softer than steel, a softer abrasive can be used with the blast stripping method. An example of such is disclosed in U.S. Pat. No. 4,878,320 to remove coatings from aluminum, fiberglass or carbon fiber laminate. As disclosed in the patent, an abrasive particle is used which has a Mohs hardness of about 3. Sodium bicarbonate is a preferred material.

Other patents which disclose cleaning metal surfaces with an abradant other than sand include U.S Pat No. 2,624,988 which utilizes a mixture of Tripoli paste and a liquid vehicle to which mixture can be added sponge rubber fragments which carry the abradant to the metal surface and which provide a rubbing action to polish and buff the metal surface.

U.S. Pat. No. 2,710,286 discloses a method of removing fluorescent and other materials from viewing screens of cathode ray tubes in which sodium and potassium carbonate are used as the abrasive material. U.S. Pat. No. 4,588,444 discloses removing calcium from polymeric contact lenses by using as an abradant sodium chloride, sodium bicarbonate or a mixture of same. U.S. Pat. No. 4,731,125 discloses a method for removing adherent material from composite surfaces made of a reinforced matrix material using a granular media composed of particles which have a Mohs hardness of lower than 3.5. Preferably the abradant is polymeric particles.

Polymer particles are commercially available for use as non-abrasive stripping, cleaning, deburring, and deflashing media. These non-abrasive media are particularly useful when the substrate is susceptible to damage. Such substrates include aircraft and aerospace components, dye castings, computer housing panels, vehicle and boat bodies.

U.S. Pat. Nos. 5,505,749 and 5,509,971 to Kirshner et al. disclose the use of a major amount of a granular relatively soft abrasive having a Mohs hardness of less than 4 and a minor portion of a granular hard abrasive having a Mohs hardness of greater than 5. U.S. Pat. No. 5,234,470 to Lynn et al. discloses a granulated composite, in particular, a flexible open cell water-foamable material and an abrasive mineral such as garnet.

PROBLEM TO BE SOLVED BY THE INVENTION

It would be desirable to be able to clean an external surface more rapidly without damaging the underlying surface. It would also be desirable to be able to more finely control or tailor the abrasive properties of the media to balance its ability to remove a particular coating without attacking a particular surface material. It would be desirable for the media to be durable and non-friable and not produce dust during use. It would also be desirable for the media to flow through the propelling equipment without clogging nozzles or requiring special treatment to prevent static cling.

It would be desirable to be able to economically manufacture and customize such particles for a particular application.

It would be desirable to accomplish this without using chemicals that present environment or health problems. It is an object of the invention to remove surface materials without harming the underlying surface of the structure and which is more effective than other known non-abrasive media.

SUMMARY OF THE INVENTION

The above objects are achieved by providing an abrasive media that comprises a polymeric core surrounded by a layer of inorganic particles. The media can be propelled against or along an external surface by a gaseous or liquid carrier medium or a mixture of gas and liquid to remove the unwanted surface material. By the term "external surface", with respect to the surface being cleaned, is meant a surface that, during use, is not enclosed but rather is freely open or exposed to the ambient atmosphere, as it will be exposed to the cleaning composition of the present invention. Thus, internal surfaces, such as the concave surface of a conduit or an enclosed tank, is excluded. Typically the abrasive media of the present invention is applied by shooting or blasting the media through air, specifically the air space between the external surface to be cleaned and the means for shooting or propelling the particles.

This invention can be used for removing adherent materials, for example, paint, flashes, burrs, photoresists, contaminants, biogrowth, and other materials from various surfaces. Contaminants to be removed from a surface may include any foreign substance attached to or carried by the surface such as scale, soil, grease, oil, soot, solvents and other objectionable deposits. In another type of situation, the surface material may be a previously applied material such as a paint or photoresist.

In one embodiment, suitable blasting equipment propels the media, via a pressurized air stream, against a surface of an object to dislodge and/or absorb any contaminant thereon.

DETAILED DESCRIPTION OF THE INVENTION

In its broadest aspect, the abrasive media of the present invention comprises a polymeric core surrounded by a shell of inorganic particulate. The polymeric core can be any naturally occurring or synthetic polymer such as, for example, olefin homopolymers and copolymers, such as polyethylene, polypropylene, polyisobutylene, polyisopentylene and the like; polyfluoroolefins such as polytetrafluoroethylene, polyvinylidene fluoride and the like, polyamides, such as, polyhexamethylene adipamide, polyhexamethylene sebacamide and polycaprolactam and the like; acrylic resins, such as polymethylmethacrylate, polyethylmethacrylate and styrene-methylmethacrylate or ethylene-methyl acrylate copolymers, ethylene-ethyl acrylate copolymers, ethylene-ethyl methacrylate copolymers, polystyrene and copolymers of styrene with unsaturated monomers mentioned below, polyvinyltoluene, cellulose derivatives, such as cellulose acetate, cellulose acetate butyrate, cellulose propionate, cellulose acetate propionate, and ethyl cellulose; polyvinyl resins such as polyvinyl chloride, copolymers of vinyl chloride and vinyl acetate and polyvinyl butyral, polyvinyl alcohol, polyvinyl acetal, ethylene-vinyl acetate copolymers, ethylene-vinyl alcohol copolymers, and ethylene-allyl copolymers such as ethylene-allyl alcohol copolymers, ethylene-allyl acetone copolymers, ethylene-allyl benzene copolymers ethylene-allyl ether copolymers, ethylene-acrylic copolymers and polyoxy-methylene, polycondensation polymers, such as, polyesters, including polyethylene terephthalate, polybutylene terephthalate, polyurethanes and polycarbonates. Styrenic or acrylic polymers are preferred. Polystyrene and polymethylmethacrylate are especially preferred.

The polymeric core can be selected in order to provide desirable properties. For instance, polymers are well known which are soft or hard, elastic or inelastic, etc. It can be particularly advantageous to crosslink the polymer in order to increase it's strength and make it resistant to fracture. In its broadest aspect, the blast media of the present invention encompasses the use of a polymeric core having a hardness of less than 5.0, preferably less than 4.0 and even less than 3.0 on the Mohs scale The shell of the abrasive blast media of this invention, which adheres to the polymeric core, is an inorganic particulate which can act as a hard abrasive to provide a grit which abrades the surface in a controlled fashion without effecting the mechanical integrity of the structure being blast cleaned for the removal of coating layers. In its broadest aspect, the blast media of the present invention encompasses the use of an inorganic particulate having a hardness of at least 5.0, preferably at least 6.0 and even about 7.0 and above on the Mohs scale. Non-limiting examples include aluminum oxide, silicon carbide, tungsten carbide, silica, alumina, alumina-silica, tin oxide, titanium dioxide, zinc oxide or garnet and the like. The hard abrasive can be from about 5 nanometers to 1000 nanometers in size, preferably from about 10 nm to 100 nm in size. The preferred hard abrasive is colloidal silica.

The media in accordance with the present invention flows readily through the propelling equipment. However, it may also be useful in accordance with the present invention to include a flow aid or an anti-caking agent with the blast media. Most preferably, the flow aid is a hydrophilic silica, hydrophobic silica, hydrophobic polysiloxane or mixture thereof.

Any suitable method of preparing core/shell particles having a polymeric core adherently covered with a shell of inorganic particles may be used to prepare the particulate media for use in accordance with this invention. For example, suitably sized polymeric particles may be passed through a fluidized bed or heated moving or rotating fluidized bed of inorganic particles, the temperature of the bed being such as to soften the surface of the polymeric particles thereby causing the inorganic particles to adhere to the polymer particle surface. Another technique suitable for preparing polymer particles surrounded by a layer of inorganic particles is to spray dry the particles from a solution of the polymeric material in a suitable solvent and then before the polymer particles solidify completely, pass the particles through a zone of inorganic particles wherein the coating of the polymeric particles with a layer of the inorganic particles takes place. Another method to coat the polymer particles with a layer of inorganic particles is by mechanofusion.

A still further method of preparing the particulate media in accordance with this invention is by limited coalescence. This method includes the "suspension polymerization" technique and the "polymer suspension" technique. In the "suspension polymerization" technique, a polymerizable monomer or monomers are added to an aqueous medium containing a particulate suspension of inorganic particles to form a discontinuous (oil droplets) phase in a continuous (water) phase. The mixture is subjected to shearing forces by agitation, homogenization and the like to reduce the size of the droplets. After shearing is stopped an equilibrium is reached with respect to the size of the droplets as a result of the stabilizing action of the inorganic particulate stabilizer in coating the surface of the droplets and then polymerization is completed to form an aqueous suspension of polymeric particles in an aqueous phase having a uniform layer thereon of inorganic particles. This process is described in U.S. Pat. Nos. 2,932,629 and 4,148,741 incorporated herein by reference.

In the "polymer suspension" technique, a suitable polymer is dissolved in a solvent and this solution is dispersed as fine water-immiscible liquid droplets in an aqueous solution that contains inorganic particles as a stabilizer. Equilibrium is reached and the size of the droplets is stabilized by the action of the inorganic particles coating the surface of the droplets. The solvent is removed from the droplets by evaporation or other suitable technique resulting in polymeric particles having a uniform coating thereon of inorganic particles. This process is further described in U.S. Pat. No. 4,833,060 issued May 23, 1989, assigned to the same assignee as this application and herein incorporated by reference.

In practicing this invention, using the suspension polymerization technique, any suitable monomer or monomers may be employed such as, for example, styrene, vinyl toluene, p-chlorostyrene; vinyl naphthalene; ethylenically unsaturated mono olefins such as ethylene, propylene, butylene and isobutylene; vinyl halides such as vinyl chloride, vinyl bromide, vinyl fluoride, vinyl acetate, vinyl propionate, vinyl benzoate and vinyl butyrate; esters of alphamethylene aliphatic monocarboxylic acids such as methyl acrylate, ethyl acrylate, n-butylacrylate, isobutyl acrylate, dodecyl acrylate, n-octyl acrylate, 2-chloroethyl acrylate, phenyl acrylate, methyl-alphachloroacrylate, methyl methacrylate, ethyl methacrylate and butyl methacrylate; acrylonitrile, methacrylonitrile, acrylamide, vinyl ethers such as vinyl methyl ether, vinyl isobutyl ether and vinyl ethyl ether; vinyl ketones such as vinyl methylketone, vinyl hexyl ketone and methyl isopropyl ketone; vinylidene halides such as vinylidene chloride and vinylidene chlorofluoride; and N-vinyl compounds such as N-vinyl pyrrole, N-vinyl carbazole, N-vinyl indole and N-vinyl pyrrolidone, divinyl benzene, ethylene glycol dimethacrylate, mixtures thereof; and the like. Preferred are styrene or methyl methacrylate.

If desired, a suitable crosslinking monomer may be used in forming polymer particles by polymerizing a monomer or monomers, including a monomer or monomers that are polyfunctional with respect to the polymerization reaction, within droplets in accordance with this invention to thereby modify the polymeric particle and produce particularly desired properties. Typical crosslinking monomers are aromatic divinyl compounds such as divinylbenzene, divinylnaphthalene or derivatives thereof; diethylene carboxylate esters and amides such as diethylene glycol bis (methacrylate), diethylene glycol diacrylate, and other divinyl compounds such as divinyl sulfide or divinyl sulfone compounds.

In the suspension polymerization technique, other addenda are added to the monomer droplets and to the aqueous phase of the mass in order to bring about the desired result including initiators, promoters and the like which are more particularly disclosed in U.S. Pat. Nos. 2,932,629 and 4,148,741, both of which are incorporated herein in their entirety.

Useful solvents for the polymer suspension process are those that dissolve the polymer, which are immiscible with water and which are readily removed from the polymer droplets such as, for example, chloromethane, dichloromethane, ethyl acetate, propyl acetate, vinyl chloride, methyl ethyl ketone, trichloromethane, carbon tetrachloride, ethylene chloride, trichloroethane, toluene, xylene, cyclohexanone, 2-nitropropane and the like. Particularly useful solvents are dichloromethane, ethyl acetate and propyl acetate because they are good solvents for many polymers while at the same time, being immiscible with water. Further, their volatility is such that they can be readily removed from the discontinuous phase droplets by evaporation or boiling.

The quantities of the various ingredients and their relationship to each other in the polymer suspension process can vary over wide ranges. However, it has generally been found that the ratio of the polymer to the solvent should vary in an amount of from about 1 to about 80% by weight of the combined weight of the polymer and the solvent and that the combined weight of the polymer and the solvent should vary with respect to the quantity of water employed in an amount of from about 25 to about 50% by weight. The size and quantity of the inorganic particulate stabilizer depends upon the size of the particles of the inorganic particulate and also upon the size of the polymer droplet particles desired. Thus, as the size of the polymer/solvent droplets are made smaller by high shear agitation, the quantity of solid colloidal stabilizer is varied to prevent uncontrolled coalescence of the droplets and to achieve uniform size and narrow size distribution of the polymer particles that result. The suspension polymerization technique and the polymer suspension technique herein described are the preferred methods of preparing the particulate media having a core/shell structure comprising a polymeric core with a shell of inorganic particles for use in accordance with this invention. These techniques provide particles having a predetermined average diameter anywhere within the range of from 10 micrometer to about 2000 micrometers with a very narrow size distribution. The coefficient of variation (ratio of the standard deviation) to the average diameter, as described in U.S. Pat. No. 2,932,629, referenced previously herein, are normally in the range of about 15 to 35%.

The particle size of the abrasive particulates will range from about 10 to 2,000 $\mu$m, preferably from about 30 to about 1,000 $\mu$m, and most preferably from about 100 to 700 $\mu$m.

The process of this invention is particularly useful for applications where the surface being cleaned is susceptible to damage such as those listed below:

In one embodiment, a method according to the present invention is used in the printed circuit industry to remove resist from printed circuit boards. In particular, resist removal from a processed printed circuit substrate is facilitated using the core/shell particles as described above. The use of such particles helps to simplify and shorten the resist removal process without damaging the delicate printed circuit lines or the underlying substrate material. The use of such particles also enables a process yielding an environmentally safe waste, one without caustic liquids intermingled with spent resist as described, for example, in U.S. Pat. No. 5,145,717.

In another embodiment, a method according to the present invention is used for flash removal from a molded product. Molded products, such as obtained through a plastic encapsulation step of semiconductor devices such as ICs or LSIs often have flashes. Flash removal is facilitated using core/shell particles of this invention. This avoids the use of a hard abrasive as discussed above and the problems associated with using these abrasives.

In another embodiment, a method according to the present invention is used for removing a coating from an airplane, missile or other substrates or skins in the aerospace industry. Plastic media blasting (PMB) has been in use since the late 1980's, principally for stripping paint and cured powder coatings from aircraft and aerospace components which can not survive more aggressive removal processes. Substrates such as aluminum and aluminum alloys are especially sensitive. See, for instance, "Using Plastic Media Blasting to Remove Powder Coatings from Parts", Powder Coating, April 1996, incorporated by reference in its entirety. The use of PMB using core/shell particles of the present invention allows for the faster removal of coatings in the aerospace industry.

In another embodiment, a method according to the present invention is used to remove coatings from composites. The class of materials referred to as composites present special problems. Composites are usually made of a matrix material, such as plastic or epoxy, which often contains fibers such as glass strands, graphite, KEVLAR polymer or the like for reinforcement. Layers of the material are laminated together or pressed onto a honeycomb base to form structural material. Such composites are strong and light and are increasingly used in aircraft, boats and other manufactured products where weight savings are important. Because composites usually have surfaces which are softer than metals, removal of paint or other coatings from composites must be done carefully to avoid excessive abrasion or chemical damage. U.S. Pat. No. 4,731,125 teaches paint removal from composites using a granular plastic material, which patent is hereby incorporated by reference. The use of core/shell particles according to this invention allows for faster removal of paint from composites.

Various abrasive blasting techniques can be utilized to remove coatings from surfaces. Thus, blasting techniques include, for example, dry blasting which involves directing the abrasive particles to a surface by means of pressurized air typically ranging from 30 to 150 psi; wet blasting in which the abrasive blast media is directed to the surface by a highly pressurized stream of water typically 3,000 psi and above; multi-step processes comprising dry or wet blasting and mechanical techniques such as sanding, chipping; and single step processes in which both air and water are utilized in combination to propel the abrasive blast media to the surface as disclosed, for example, in U.S. Pat. No. 4,817,342, incorporated by reference.

In some cases, an anchor pattern (some surface roughness) may be desirable or allowable, for example, when removing or stripping old paint to be replaced with new paint.

In methods of this invention, the media is accelerated to a flow which is effective for blast cleaning. Acceleration can be accomplished by a suitable media propelling means, such as a pneumatic sand blaster, or similar device. Preferably, the media propelling means will have a movable media outlet such as a nozzle, which allows the media flow to be directed over a target surface area to be cleaned. The media propelling means should produce an output pressure for the media flow of approximately 40 to 150 pounds per square inch (psi). 40 psi is a lower pressure than is used in most sand blasting operations. Conventional sand blasters can often be modified to output media at 40 psi by a simple adjustment, or, in some cases, by the addition of a pressure regulator to the equipment. Although the pressure of the media flow need not be exact to practice the present invention, it is often important that pressures substantially higher than desired are not used since higher pressures tend to damage delicate substrates.

A typical configuration for practicing the present invention includes pressure blast cleaning equipment manufactured by Clemco Industries. Such equipment includes a reservoir of media to be accelerated. Pneumatic pressure blast cleaners also include an inlet line from a source of pressurized air or other gas. A pressure regulator may also be provided to reduce the inlet pressure supplied through the inlet line. The outlet from media propeller includes a long flexible tube or hose through which the pressurized media flows. At the end of hose is a nozzle which serves as a media outlet and as a means for directing the media flow emerging from the nozzle. The media flow will be a mixture of pressurized air or other pressurizing gas and the media particles, which will emerge in high volume and at relatively high speed. For the purposes of practicing the present invention, media flow will be substantially continuous and have a pressure at the nozzle of approximately 40 to 150 psi The nozzle diameter determines the diameter of media flow. A larger nozzle size requires a greater volume of pressurized air at the inlet line and produces a correspondingly larger volume of media flow at the nozzle. Nozzle sizes of ¼ inch and ½ inch are effective with the present invention, although larger sizes can be used if pressure blast equipment of sufficient capacity is available. Regardless of the nozzle size, it is anticipated that the media flow will be confined by the nozzle to a diameter which is substantially smaller than the size of the target surface to be cleaned. As such, the media flow will be directed over the target surface in the manner described below in order to remove adherent material from the surface being treated.

Directing the media flow at the target surface constitutes the next step in the method of the present invention. It is anticipated that in most applications of the present invention the surface to be cleaned will be stationary and the nozzle will be moved to clean the surface. For example, in cleaning composite surfaces on an aircraft fuselage or the like, a person holding the nozzle will direct the media flow over the target surface in a varying manner until the surface is cleaned.

In order to remove paint and other adherent material efficiently from surfaces, it is preferable that the path of the media flow against the target surface be optimized. An optimal path of media flow will be one in which the angle and direction of the media flow produces highly efficient removal of adherent material from the surface without damage to the surface. This is generally done by angling the media flow away from a perpendicular direction with respect to the target surface so that the leading edge of the coating being removed is exposed to the force of the media flow. An optimal path of media flow with respect to a surface will be directed at the leading edge of the adherent material to be removed. The angle of the media flow with respect to perpendicular is increased to increase the rate of removal. An increase in the angle results in more media particles being available to dislodge the adherent layers at the leading edge. For this reason, it is preferred that the angle be increased until the observed effectiveness of the removal action is maximized, and that angle then becomes the optimal path of media flow.

Another preferred step in the cleaning process is the efficient redirection of the media flow over the target composite surface until the entire surface is cleaned. It has been found that this is best accomplished by directing the media flow primarily at areas of adherent material remaining to be removed, and then redirecting the media flow to other unremoved areas whenever removal in the first area is substantially accomplished. In this way, exposure of cleaned, and therefore unprotected, surface to the full force of the media blast is minimized. During the entire cleaning process, an optimal path or angle of media flow is preferably maintained. Only at the start of the cleaning process or at other times when obstructions prohibit selection of an angle for the media flow will it be best to keep the media flow perpendicular to the target surface. At other times, the maintenance of an optimal path in response to the observed effectiveness of action of the media flow will produce the most efficient and effective surface cleaning action by the media flow.

The above-described process for the removal of adherent material from surfaces has proven to be superior to prior art surface cleaning techniques. Media blast eliminates entirely the need to use hazardous chemicals for surface cleaning. Not only is there a substantial savings of both time and labor, but the health, safety, pollution and disposal problems associated with chemical paint stripping are entirely eliminated. Other advantages of surface cleaning by the present invention include the ability to selectively remove outer layers of material while having underlying layers intact. This can be done by carefully directing the media flow at an area only until the desired layers are removed, leaving remaining layers intact. While such selective removal cannot be performed in some circumstances, such as where an underlying layer is too soft to remain intact, it is virtually impossible to perform selective removal with chemicals. It is also possible to modify the core/shell in order to achieve specific results. Such modifications include, for example, variations in the particle size, hardness, elasticity etc of the core and variations in the particle size, hardness and material of the abrasive grit shell.

The composite surface cleaning system can be modified to meet the needs of particular situations. For example, the blast pressure media particle size and angle of media flow can all be modified in order to facilitate efficient cleaning without damage to the composite surface. Small or angled nozzles can be employed in confined areas or to reach otherwise inaccessible parts of a composite surface. Other modifications within the scope of this invention include the use of other types of media propelling means or of other means to direct the media flow.

EXAMPLE 1

This example illustrates the synthesis of various core/shell particles for use in a method according to the present invention.

Preparation of 575 μm Crosslinked Beads

Inhibitor is removed from a mixture of 1320 g of styrene and 5280 g divinylbenzene (55% grade from Dow Chemical Co.) by slurrying with 132 g Dowex SBR-P(OH) Anion Exchange Resin for 15 minutes followed by filtering off the resin. 129 g of benzoyl peroxide (sold as Lucidol 75®) by Pennwalt Corp) are then dissolved in this uninhibited monomer mixture. In a separate vessel is added 8745 g of demineralized water to which is added 8.6 g of citric acid, 8.6 g of potassium hydrogen phthalate, 4.7 g of poly(2-methylaminoethanol adipate), and 8.9 g of Nalco 1060®, a 50% colloidal suspension of silica sold by Nalco Corp. The uninhibited monomer mixture is added to the aqueous phase and stirred to form a crude emulsion. This is passed through a Gaulin colloid mill operated at 7.56 1/minute feed rate, 1500 rev/min and gap setting of 0.0381 cm. To this is added a solution of 33.6 g polyvinyl alcohol (Airvol® 523) dissolved in 2200 g of demineralized water. The mixture is heated to 61° C. for 16 hours followed by heating to 85° C. for 4 hours. The resulting solid beads are sieved through an 18 mesh sieve screen to remove oversized beads and the desired beads which pass through the screen are collected by filtration. The collected beads are placed on a 70 mesh screen and washed with distilled water to remove undersized particles. The beads are then collected by filtration and the filter cake is rinsed with 6000 g demineralized water. The beads are then vacuum dried at 50° C. for 3 days. The resultant particles are 575 μm in size and are a crosslinked polystyrene core covered with colloidal silica.

Preparation of 575 μm Crosslinked Beads without Shell of Inorganic Particles (Comparative)

The beads from above are slurried in 4 L of 1 N NaOH solution and stirred for 1 hour. The beads are filtered and redispersed in 4 L of 0.1 N NaOH solution and stirred overnight. The beads are filtered and successively re-slurried in 4 L of demineralized water until the filtrate pH is <8.5. The beads are then filtered and dried in a vacuum oven overnight at 80° C. for 2 days. The resultant particles are 575 μm in size and are a crosslinked polystyrene bead without a shell of inorganic particles.

EXAMPLE 2

This Example demonstrates the cleaning efficacy of the method of the present invention.

Preparation of Test Panels

One-foot-by-one-foot squares were cut from a 4-foot-by-12 foot piece of Aircraft Aluminum 6061 T6. These were coated with a typical aircraft paint system purchased from DuPont. The system consisted of one coat of Imron 6000 Low VOC polyurethane enamel basecoat applied at 1 mil (0.001 inches) thick followed by one coat of 3440 Low VOC polyurethane clearcoat applied at 2 mils thick. These were allowed to cure for approximately 2 weeks at 100 F.

Paint Removal Procedure

A standard blast chamber equipped with a production size blastpot and a ¼-inch venturi nozzle (commonly used in the industry) on a ten foot, 1-inch blasting hose was used. The painted test panels from above were mounted on a steel plate with two-sided tape. They were blasted from a distance of 12 inches with a pressure of 100 psi.

Test 1

A 2268-gram quantity of 570 μm beads as prepared in Example 1 above, with a shell of colloidal silica, were placed in the equipment. Blasting at 100 psi continued until the abrasive stopped flowing; approximately 3.5 minutes. The paint was removed from the panel and the powder flow through the equipment was good. The panel was viewed with a 200× stereo zoom microscope. No damage to the aluminum panel was found.

Comparative Test 2

A 3629-gram quantity of beads without a shell of colloidal silica, for comparison, were placed in the blast pot. The material did not flow though the venturi nozzle.

The invention has been described in detail with particular reference to certain preferred embodiments thereof, but it will be understood that variations and modifications can be effected within the spirit and scope of the invention.

What is claimed is:

1. A process for removing material from an external surface, the method comprising employing propelling means to propel a particulate media, entrained in a fluid, against said surface, characterized by the particulate media comprising particles, 30 to 2,000 μm in size, having a core/shell structure in which a polymeric core is adherently covered with a shell of inorganic particles, wherein said propelling means produces an output pressure for media flow of at least 40 pounds per square inch.

2. The process according to claim 1 in which the method comprises cleaning or polishing the surface by removing and discarding the removed material.

3. The process according to claim 1 in which the material to be removed is paint.

4. A process according to claim 1 wherein the particles are propelled against the surface by a controlled flow of a fluid comprising air and/or water.

5. A process according to claim 4 wherein the air is compressed air.

6. A process according to claim 1 wherein the material to be removed is a photoresist.

7. A process according to claim 3 wherein the surface is that of an airplane or part thereof.

8. A process according to claim 1 wherein the fluid is a liquid.

9. A process according to claim 8 wherein the fluid is primarily water.

10. A process according to claim 9 wherein the liquid further comprises sequestering agents and/or surfactants.

11. A process according to claim 1 wherein the fluid is a gas.

12. A process according to claim 11 wherein the fluid is compressed air.

13. A process according to claim 11 wherein the fluid is an inert gas.

14. A process according to claim 11 wherein the gas further comprises an antistatic agent.

15. A process according to claim 1 wherein the core is a styrenic or acrylic polymer.

16. A process according to claim 1 wherein the core is crosslinked.

17. A process according to claim 1 wherein the inorganic particles are colloidal silica.

* * * * *